United States Patent [19]

Feierstein et al.

[11] 4,162,236

[45] Jul. 24, 1979

[54] DETERGENT COMPOSITIONS CONTAINING MIXTURES OF ALKYLBENZENE SULFONATES AS THE DETERGENT ACTIVE

[75] Inventors: Harold E. Feierstein, Creve Coeur, Mo.; Mark E. Davis, Lexington, Ky.

[73] Assignee: Monsanto Company, St. Louis, Mo.

[21] Appl. No.: 945,732

[22] Filed: Sep. 25, 1978

Related U.S. Application Data

[63] Continuation of Ser. No. 867,074, Jan. 5, 1978, abandoned.

[51] Int. Cl.[2] ..... C11D 1/22

[52] U.S. Cl. ..... 252/558; 252/539

[58] Field of Search ..... 252/539, 558; 260/505 A, 505 S, 503, 671

[56] References Cited

U.S. PATENT DOCUMENTS

| | | | |
|---|---|---|---|
| 3,316,294 | 4/1967 | Feighner et al. | 260/505 |
| 3,320,174 | 5/1967 | Rubinfeld | 252/539 |
| 3,349,141 | 10/1967 | Sweeney | 260/668 |
| 3,358,047 | 12/1967 | Liston | 260/668 |
| 3,442,811 | 5/1969 | Connor et al. | 252/539 |
| 3,487,023 | 12/1969 | Sweeney | 252/558 |
| 3,769,243 | 10/1973 | Straus | 252/558 |

OTHER PUBLICATIONS

Gray et al., Journal of the American Oil Chemist Society, "Some Detersive Properties of Model Straight Chain Sodium Alkylbenzene Sulfonates," Nov. 1965, pp. 998-1001.

*Primary Examiner*—P. E. Willis

*Attorney, Agent, or Firm*—S. M. Tarter; E. P. Grattan; F. D. Shearin

[57] ABSTRACT

Powdered detergent compositions containing a surfactant, fillers, builders and the like, can be prepared by removing water from the detergent composition to form the powder. Frequently, such powdered detergent compositions are hygroscopic and lose the free-flowing characteristics upon storage. According to the present invention, a detergent composition which comprises at least 5 percent by weight of a mixture of alkyl benzene sulfonates wherein greater than 55 mole percent of the alkyl benzene sulfonates have alkyl chains of greater than 11 carbon atoms, the alkyl chains having 12 or more carbon atoms have a 2-phenyl content greater than 60 percent of the total 2-phenyl content, along with other detergent ingredients are provided which provides a free-flowing dry composition that is less hygroscopic than prior art products.

5 Claims, No Drawings

DETERGENT COMPOSITIONS CONTAINING MIXTURES OF ALKYLBENZENE SULFONATES AS THE DETERGENT ACTIVE

This is a continuation of application Ser. No. 867,074, filed Jan. 5, 1978, now abandoned.

BACKGROUND OF THE INVENTION

This invention relates to detergent formulations and more particularly relates to detergent formulations containing alkyl benzene sulfonates.

The alkali metal and ammonium salts of alkyl benzene sulfonates have been used for decades as the active surfactant in synthetic detergent formulations, particularly in the heavy duty laundry detergents used by the American housewife. Such heavy duty laundry detergents typically contain 5 percent or more of an alkyl benzene sulfonate wherein the alkyl chain has between 10 and 15 carbon atoms, which is known to those skilled in the art to be an outstanding surfactant for this purpose.

In particular, such detergent formulations are usually free-flowing substantially dry powders which are prepared by removing water from a blend of the alkyl benzene sulfonate with a filler, a builder, optical brighteners, perfumes and the like. On the other hand, some detergent formulations are prepared by making a physical mixture of the dried alkyl benzene sulfonate on a filler with builders, perfumes, optical brighteners and other detergent ingredients.

Although such products have satisfactory cleaning performance on clothing and hard surfaces, such detergent formulations are frequently hygroscopic, causing the dried detergent to become tacky, and the formulation loses some, if not all, of its free-flowing characteristics. This is particularly true in those detergent formulations where phosphate salts have been removed from the formulation in favor of non-phosphate builders because of the recent emphasis on removing phosphates frpom detergent and cleaning compositions for environmental reasons.

To overcome these problems, those skilled in the art of detergent formulation have added materials to the detergent formulation to reduce the tendency of the dry detergent to cake and to lose its free-flowing characteristics. Although these materials have reduced the tendency of the dry detergent to lose its free-flowing characteristics, the detergent powder frequently becomes tacky and loses its free-flowing characteristics, even with these additives present, because the alkyl benzene sulfonate used in the formulation is so hygroscopic, particularly under high humidity conditions.

Thus, it can be seen that there is a need for a detergent formulation that contains alkyl benzene sulfonate which is an outstanding surfactant for home laundry applications, which is not hygroscopic and thus cause the dry detergent formulation to lose its free-flowing characteristics, with or without special additives to prevent such tackiness.

SUMMARY OF THE INVENTION

These and other disadvantages in the prior art are overcome by a detergent composition of the present invention which comprises at least 5 percent by weight, based on the total weight of the composition, of a mixture of alkyl benzene sulfonates wherein (A) greater than 55 mole percent of the alkyl benzene sulfonates have alkyl chains of greater than 11 carbon atoms, (B) the alkyl chains having 12 or more carbon atoms have a 2-phenyl content of greater than 60 percent of the total 2-phenyl content.

For the purposes of this invention, the term "2-phenyl" as it is used in the specification and claims shall mean that the phenyl group of the alkyl benzene sulfonate salt is attached to the second carbon atom on the alkyl chain.

Broadly described, the mixture of the present invention is prepared by admixing aqueous alkyl benzene sulfonate of the present invention with a filler and optionally a builder, and thereafter removing the water from the mixture by conventional techniques.

The mixture of alkyl benzene sulfonate of the present invention can be prepared by techniques known to those skilled in the art such as that disclosed in U.S. Pat. No. 3,585,253 or U.S. Pat. No. 3,349,144. Broadly described, a suitable aromatic hydrocarbon such as toluene, xylene, cumene and other lower alkyl benzenes in which the number of alkyl side chains is not in excess of about 2 and the alkyl chain length in each instance is not in excess of 4 carbon atoms, preferably benzene, is reacted with a mixture of alefins containing 10 to 15 carbon atoms in a conventional manner using any Friedel-Crafts catalyst, such as aluminum chloride, boron trifluoride or hydrogen fluoride, preferably hydrogen fluoride. The alkylation reaction can be conducted using conventional temperatures and pressures and using conventional ratios of reactants. The specific reaction temperature most advantageously employed depends upon the particular alkylation catalyst and other considerations but in most instances will range from −20° C. to +80° C. The ratio of catalyst to olefin can be conventional and the preferred ratio will depend upon the particular catalyst employed. For example, when employing an HF catalyst, the molar ratio of olefin to catalyst can range from about 1:5 to about 1:25 with the preferred ratio being about 1:15 to about 1:20. The reaction can be satisfactorily conducted at substantially atmospheric pressure, but if desired the reaction can be conducted under either vacuum or higher pressures and one can employ, for example, pressures ranging from 0.1 to 10 atmospheres with satisfactory results.

Since the 2-phenyl content of the alkyl benzene is determined largely by the catalyst and reaction temperatures, it is necessary to separate the alkyl benzene having the high 2-phenyl content from alkyl benzenes wherein the aromatic moiety is at other than the 2-phenyl position on the alkyl chain. As will occur to those skilled in the art in view of the present disclosure, this can be accomplished by introducing alkyl benzenes having an alkyl chain length between 10 and 15 carbon atoms into a distillation column containing from about 10 to about 30 theoretical plates operated at a pressure between about 30 Torr and about 100 Torr and at a temperature between about 250° C. and about 280° C. and withdrawing at about the midpoint of the distillation column a side stream containing a mixture of alkyl benzenes wherein greater than 55 mole percent of the alkyl chains have greater than 11 carbon atoms and wherein the alkyl chains having 12 or more carbon atoms have a 2-phenyl content of greater than 60 percent of the total 2-phenyl content.

The mixture of alkyl benzenes prepared as above described can be transformed into an anionic detergent active material by sulfonation and neutralization by conventional procedures known to those skilled in the art. For example, the alkyl benzene mixture can be sulfonated by the use of either sulfur trioxide or by the use of sulfuric acid and the resulting alkyl benzene sulfonic acid mixture can be neutralized with an alkali metal hydroxide or carbonate, such as sodium carbonate or sodium hydroxide, or by the use of any other suitable base conveniently employed in the manufacture of alkyl benzene sulfonate detergent actives. After the salt of the mixture of alkyl benzene sulfonates has been prepared as described above, the water can be removed from the mixture of alkyl benzene sulfonates by techniques known to those skilled in the art. For example, the mixture of alkyl benzene sulfonates can be admixed with a detergent filler, such as sodium sulfate and the like, or with a builder, such as sodium tripolyphosphate (STP), and drum dried using a drum at a temperature above about 100° C. On the other hand, a mixture of the alkyl benzene sulfonate salt and a filler and/or builder can be spray-dried in a tower wherein most of the water is removed when droplets of the aqueous product are passed through a counter-current or co-current flow of heated air at temperatures of about 275° C. to about 350° C., and collecting the dried detergent active, containing from about 0.5 weight percent to about eight percent water, at the bottom of the tower.

Any number of fillers known to those skilled in the art can be used in the process of the present invention. The filler can be soluble or insoluble although soluble fillers are preferred. Examples of water insoluble fillers include talc, chalk and the like. Examples of water soluble fillers include sodium sulfate, sodium chloride, sodium carbonate, potassium sulfate, potassium chloride, potassium carbonate and the like. Sodium sulfate is preferred.

As will occur to those skilled in the art, in the event that the detergent formulation contains a builder, the builder can be admixed with the mixture of alkyl benzene sulfonates of the present invention either before or after the water is removed from the mixture. By way of example, builders which can be employed in combination with the mixture of alkyl benzene sulfonates of the present invention include either water insoluble materials such as sodium alumino silicates, commonly known as zeolites, or water soluble inorganic builder salts such as the alkali metal polyphosphates, i.e., the tripolyphosphates and pyrophosphates, alkali metal carbonates, borates, bicarbonates and silicates and water soluble organic builders including amino polycarboxylic acids and salts, such as alkali metal trinitrilotriacetates, cycloalkane polycarboxylic acids and salts, ether polycarboxylates, alkyl polycarboxylates, epoxy polycarboxylates, tetrahydrofuran polycarboxylates, benzene polycarboxylates, oxidized starches, amino(trimethylene phosphonic acid) salts, diphosphonic acid salts, such as the sodium salts of methylene diphosphonic acid or 1-hydroxy ethylidene-1,1-dimethylene phosphonic acid and the like. Mixtures of such builders may also be used.

The detergent composition of the present invention can optionally contain from 5 percent to 95 percent by weight total builder (although greater or lesser quantities may be employed if desired). The total amount of builder employed will be dependent on the intended use of the detergent composition, other ingredients, pH conditions and the like. For example, general laundry powder formulations will usually contain from about 20 percent to about 60 percent builder; and machine dishwashing formulations will usually contain from about 60 percent to about 90 percent builder. On the other hand, powder formulations, such as those used in automobile car washes, do not normally contain any builders. Optimum levels of builder content as well as optimum mixtures of builders for various uses can be determined by routine tests in accordance with conventional detergent formulation practice.

The detergent compositions of the present invention may also optionally contain another water soluble detergent surfactant, provided that the benefits achieved by the mixture of alkyl benzene sulfonates of the present invention are not lost. Any number of water soluble anionic, nonionic, zwitterionic or amphoteric surfactants can be employed, as will occur to those skilled in the art. Examples of suitable anionic surfactants include soaps such as the salts of fatty acids containing about 9 to 20 carbon atoms, e.g., salts of fatty acids derived frm coconut oil and tallow; other alkyl benzene sulfonates, particularly those containing a high 2-phenyl content; alcohol sulfates, ethoxylated alcohol sulfates; hydroxy alkyl sulfonates; alkyl sulfates and sulfonates; monoglyceride sulfates; acid condensates of fatty acid chlorides with hydroxy alkyl sulfonates; and the like. Examples of suitable nonionic surfactants include alkylene oxide (e.g., ethylene oxide) condensates of mono- and polyhydroxy alcohols, alkyl phenols, fatty acid amides, and fatty amines; amine oxides; sugar derivatives such as sucrose monopalmitate; long chain tertiary phosphine oxides, dialkyl sulfoxides, fatty acid amides, (e.g., mono- or diethanol amides of fatty acids containing 10 to 18 carbon atoms); and the like. Examples of suitable zwitterionic surfactants include derivatives of aliphatic quaternary ammonium compounds such as 3-(N,N-dimethyl-N-hexadecylammonio)propane-1-sulfonate and 3-(N,N-dimethyl-N-hexadecylammonio)-2-hydroxy propane-1-sulfonate. Examples of suitable amphoteric surfactants include betains, sulfobetains and fatty acid imidazole carboxylates and sulfonates.

It will be understood that the above examples of surfactants are by no means comprehensive and that numerous other surfactants are known to those skilled in the art. It will be further understood that the choice and use of surfactants will be in accordance with well understood practices of detergent formulation.

The quantity of surfactant employed in the detergent composition of the present invention will depend, among other things, on the end use of the formulation. In general, the formulations will contain from 5 percent to 50 percent surfactant by weight, although as much as 70 percent or more surfactant may be employed if desired. For example, general laundry powder formulations normally contain 5 percent to 50 percent, preferably 15 percent to 25 percent surfactant. Machine dishwashing formulations normally contain about 0.5 percent to about 5 percent surfactant. The weight ratio of surfactant to builder will generally be in the range of from 1:12 to 2:1.

In addition to the alkyl benzene sulfonates of the present invention, the detergent compositions of the present invention may also contain other surfactant components in addition to those discussed above such as minor amounts of bleaches, dyes, optical brighteners, soil anti-redeposition agents, perfumes and the like.

DESCRIPTION OF THE PREFERRED EMBODIMENTS

This invention is illustrated by but not limited to the following Examples. All percentages are by weight unless otherwise indicated.

EXAMPLE I

In a suitable alkylation reactor equipped with a stirrer, thermocouple, cooling coil and sample port are placed 390 parts by weight of benzene and 260 parts of anhydrous HF. The benzene is heated to a temperature of about 50° C. and there is added over a period of about 5 to 10 minutes while maintaining the reaction mixture at a temperature of 50° C. and with agitation 1,000 parts by weight of a hydrocarbon mixture containing an olefin which analyzes 99 percent straight chain olefin in the $C_{11}$ to $C_{14}$ chain length range. The molar ratio of benzene to olefin is approximately 6:1 and the molar ratio of HF to olefin is about 18:1. The reaction mixture is then stirred at a temperature of 50° C. for an additional 20 minutes after which it is allowed to remain in a quiescent condition for a period of about 10 minutes. The lower catalyst phase and the upper alkylated liquor phase are then separated and the alkylated liquor is fractionally distilled to remove HF, unreacted benzene and other lower boiling organics. Distillation is continued at reduced pressure and a fraction boiling at from about 180° C. to about 300° C. at 2 Torr is collected as the alkyl benzene product.

In a sulfonation reactor are placed 500 parts of a purified alkyl benzene product as prepared above and there is slowly added over a period of about 20 minutes 600 parts of 20 percent oleum. The resulting mixture is retained at a temperature of about 25° C. for approximately 1 hour and then is quenched with approximately 200 parts of cold water. The mixture is then retained in a quiescent condition for approximately one hour and the sulfuric acid layer is separated. The resulting mixture of alkyl benzene sulfonic acids is then neutralized with 50 percent aqueous sodium hydroxide.

EXAMPLE II

The neutralized alkyl benzene sulfonate mixture from Example I is then dried in a commercial spray-drying tower by admixing 40 parts of the alkyl benzene sulfonate mixture (on a dry basis) with 60 parts of sodium sulfate and adjusting the water content to where the solids content in the aqueous solution is about 65 percent. The solution containing the sodium sulfate and the mixture of alkyl benzene sulfonates are then sprayed into a counter-current flow of air at a temperature of about 325° C. to rapidly remove the moisture from the mixture. The resulting product is removed from the spray tower at a temperature of about 80° C. Samples from this test were used in comparative studies with other alkyl benzene sulfonates prepared in an identical manner.

EXAMPLE III

A series of alkyl benzene sulfonate products were prepared using the alkyl benzene sulfonate mixture of Example I and similar alkyl benzene sulfonates falling outside the scope of the present invention. All of the products were dried according to the procedure of Example II, and the performance characteristics of the products were compared. The alkyl benzene sulfonates were analyzed by Gas-Liquid Chromatography (GLC): Sample A is the product from Example I and Samples B and C are commercially available products. The results of the analyses are presented in Table 1.

TABLE 1

GLC ANALYSES OF ALKYL BENZENE PRODUCTS

| Isomeric Analysis | Sample A | Sample B | Sample C |
|---|---|---|---|
| C-10 | 3.07 | 15.91 | 17.93 |
| 2-ϕ | 0.91 | 2.94 | 6.97 |
| C-11 | 16.32 | 45.16 | 40.48 |
| 2-ϕ | 4.95 | 5.18 | 13.00 |
| C-12 | 63.96 | 37.90 | 33.14 |
| 2-ϕ | 19.28 | 7.57 | 9.07 |
| C-13 | 16.65 | 1.03 | 7.46 |
| 2-ϕ | 0.97 | — | — |
| C-14 | — | — | 0.99 |
| Total 2-ϕ | 26.11 | 14.69 | 30.76 |

HYGROSCOPICITY

Ten gram portions of Samples A, B and C were dried according to the procedure of Example II and the weight increase was measured after the samples had been stored in air at 80 percent relative humidity and at a temperature of 22.2° C. Some portions contained an additive to reduce hygroscopicity.

Since tackiness is subjective while hygroscopicity is objective, hygroscopicity data were measured since it is known that alkyl benzene sulfonates possessing an increased hygroscopicity are more tacky than those with lower hygroscopicity. The results of the hygroscopicity tests are presented in Table 2.

TABLE 2

Hygroscopicity of Spray-Dried Beads
(40% Alkyl Benzene Sulfonates after 24 hours at 80% RH - 22° C.)

| SAMPLE | % WEIGHT GAIN |
|---|---|
| A | 2.95 |
| B | 5 |
| B + 2% sodium xylene sulfonate | 3.25 |
| C | 3.7 |
| (60% Alkyl Benzene Sulfonate) | |
| A | 4.75 |
| A + 3% sodium xylene sulfonate | 3.15 |

The data in Table 2 clearly indicate that a bead containing 60% alkyl benzene sulfonate of the present invention is less hygroscopic than a 40% bead of a material of similar composition, and the addition of the hydrotrope to a 60% active bead of the alkyl benzene sulfonate mixture of the present invention makes it superior with respect to hygroscopic characteristics, permitting the preparation of detergent compositions with 50% more surfactant.

LAUNDRY DETERGENT PERFORMANCE

A detergent formulation containing 33 percent STP, 45 percent of Sample A or Sample B, 6 percent sodium silicate, 1 percent sodium carboxymethyl cellulose, and 15 percent sodium sulfate were used to wash 100 percent cotton broadcloth test fabrics, style 7606WRL and 65/35 polyester/cotton swatches with durable press finish which had been soiled with synthetic sebum and air borne particulates. The test was made using a Tergotometer wash at 100 revolutions per minute agitator speed using three soiled swatches per bucket in a 1 liter solution and hand rinsing the swatches in tap water and drying in an oven. The detergent concentration was 0.12 percent. Using a calcium to magnesium mole ratio of 3:2, water hardnesses of 50, 100, 150 and 250 ppm as calcium carbonate were used in the wash cycle. The reflectance values on the swatches were measured using a Gardner XL-10 color difference meter on soiled and washed swatches and the changes in reflectance on washing (Δ Rd) were measured. The higher Δ Rd values indicate the best performance and for individual data points, a difference of 1.5 Δ Rd units is significant at the 95 percent confidence level, and for a total of 4 data points, a difference of 3 Δ Rd units is significant at the 95 percent confidence level. The data are presented in Tables 3 and 4.

TABLE 3

COTTON DETERGENCY PERFORMANCE OF FORMULATIONS CONTAINING SPRAY-DRIED BEADS

| | Δ Rd at Indicated Water Hardness (ppm) | | | | |
|---|---|---|---|---|---|
| Formulation | 50 | 100 | 150 | 250 | Total |
| | Wash Temperature - 24° C. | | | | |
| Sample B | 28.4 | 26.7 | 20.8 | 15.8 | 91.7 |
| Sample A | 29.8 | 26.7 | 22.9 | 15.9 | 95.3 |
| | Wash Temperature - 49° C. | | | | |
| Sample B | 27.1 | 26.5 | 21.7 | 19.8 | 95.1 |
| Sample A | 29.0 | 29.6 | 26.5 | 20.6 | 105.7 |

TABLE 4

POLYESTER/COTTON DETERGENCY PERFORMANCE OF FORMULATIONS CONTAINING SPRAY-DRIED BEADS

| | Δ Rd at Indicated Water Hardness (ppm) | | | | |
|---|---|---|---|---|---|
| Sample Identification | 50 | 100 | 150 | 250 | Total |
| | Wash Temperature - 24° C. | | | | |
| Sample B | 19.1 | 16.1 | 10.5 | 10.3 | 56.0 |
| Sample A | 23.6 | 22.6 | 17.2 | 11.4 | 74.8 |
| | Wash Temperature - 49° C. | | | | |
| Sample B | 23.4 | 16.6 | 10.5 | 11.3 | 61.8 |

TABLE 4-continued

POLYESTER/COTTON DETERGENCY PERFORMANCE OF FORMULATIONS CONTAINING SPRAY-DRIED BEADS

| | | | | | |
|---|---|---|---|---|---|
| Sample A | 28.8 | 23.2 | 19.0 | 13.1 | 84.1 |

Although the invention has been described in terms of specified embodiments which are set forth in considerable detail it should be understood that this is by way of illustration only and that the invention is not necessarily limited thereto since alternative embodiments and operating techniques will become apparent to those skilled in the art in view of the disclosure. Accordingly, modifications are contemplated which can be made without departing from the spirit of the described invention.

What is claimed is:

1. A solid detergent composition which comprises at least 5 percent by weight, based on the total weight of the composition, of a surfactant consisting essentially of a mixture of alkyl benzene sulfonates having 10 to 15 carbons in the alkyl chains wherein (A) greater than 55 mole percent of the alkyl benzene sulfonates have alkyl chains of greater than 11 carbon atoms, (B) the alkyl chains having 12 or more carbon atoms have a 2-phenyl content of greater than 60 percent of the total 2-phenyl content.

2. A detergent composition of claim 1 wherein the weight of the alkyl benzene sulfonates is between about 25 percent and about 75 percent by weight.

3. A detergent composition of claim 1 wherein the total 2-phenyl content of the alkyl benzene sulfonates is at least about 25 mole percent.

4. A detergent composition of claim 1 wherein from about 5 to about 25 mole percent of the mixture of alkyl benzene sulfonates contain alkyl chains of 11 carbon atoms, from about 50 to about 70 mole percent of the mixture contain alkyl chains of 12 carbon atoms, and from about 10 to about 25 mole percent of the mixture contain alkyl chains of 13 carbon atoms.

5. A detergent composition of claim 4 wherein the alkyl chains of 12 carbon atoms have a 2-phenyl content of greater than 60 percent of the total 2-phenyl content.

* * * * *